US010207307B2

(12) United States Patent
Becker

(10) Patent No.: US 10,207,307 B2
(45) Date of Patent: Feb. 19, 2019

(54) ROTARY SLIDE WITH COOLING AND TEMPERATURE-CONTROLLED ZONES

(71) Applicant: Bayerische Motoren Werke Aktiengesellschaft, Munich (DE)

(72) Inventor: Juergen Becker, Reichertshofen (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 15/266,162

(22) Filed: Sep. 15, 2016

(65) Prior Publication Data

US 2017/0001234 A1 Jan. 5, 2017

Related U.S. Application Data

(63) Continuation of application No. PCT/EP2015/061544, filed on May 26, 2015.

(30) Foreign Application Priority Data

Jun. 18, 2014 (DE) ..... 10 2014 211 658

(51) Int. Cl.
*B21D 37/16* (2006.01)
*B21D 19/08* (2006.01)

(52) U.S. Cl.
CPC ..... *B21D 37/16* (2013.01); *B21D 19/086* (2013.01)

(58) Field of Classification Search
CPC ..... B21D 19/086; B21D 5/04; B21D 5/042; B21D 22/08; B21D 37/16; B21D 22/022;
(Continued)

(56) References Cited

U.S. PATENT DOCUMENTS 5,916,389 A 6/1999 Lundstroem
6,523,386 B2 2/2003 Matsuoka
(Continued)

FOREIGN PATENT DOCUMENTS

CN 102172719 A 9/2011
CN 103003003 A 3/2013
(Continued)

OTHER PUBLICATIONS

English machine translation of DE10207132 (the original German publication was provided by the applicant on Sep. 15, 2016, IDS).*
(Continued)

*Primary Examiner* — Edward Tolan
(74) *Attorney, Agent, or Firm* — Crowell & Moring LLP

(57) ABSTRACT

A device for a press for shaping a sheet metal part with a section which can be shaped out separately as an undercut in the device. The device includes a press-side ram, a swage and a die which can be driven separately, serves to shape out the undercut, and interacts with an undercut contour which is arranged substantially in a filler slide which is mounted such that it can be moved rotationally in the swage. The filler slide can be transferred from a shaping-out position into a position which exposes the undercut in the sheet metal part, and vice versa. At least one temperature-control device is provided in the filler slide, by way of which temperature-control device the filler slide can be temperature-controlled at least in sections.

9 Claims, 1 Drawing Sheet

(58) Field of Classification Search
CPC .... B21D 22/208; B21D 19/082; C21D 1/673; C21D 8/02; C21D 11/005; B21J 9/06; B21J 9/08
See application file for complete search history.

(56) References Cited

U.S. PATENT DOCUMENTS

| | | | | |
|---|---|---|---|---|
| 6,810,709 | B2 * | 11/2004 | Hammar | B21D 26/031 219/483 |
| 7,254,977 | B2 * | 8/2007 | Machrowicz | B21C 37/065 72/201 |
| 2012/0113041 | A1 | 5/2012 | Westerman | |
| 2013/0205863 | A1 | 8/2013 | Loesch | |
| 2015/0336151 | A1 * | 11/2015 | Frost | B21D 22/022 72/352 |

FOREIGN PATENT DOCUMENTS

| | | | |
|---|---|---|---|
| DE | 10 2005 009 416 | A1 | 9/2006 |
| DE | 102 07 132 | B4 | 4/2007 |
| DE | 197 23 655 | B4 | 5/2007 |
| DE | 10 2008 016 118 | A1 | 9/2009 |
| DE | 10 2010 027 554 | A1 | 1/2012 |
| EP | 0 699 489 | B1 | 1/1999 |
| EP | 1 645 345 | A2 | 4/2006 |
| EP | 1 698 409 | A1 | 9/2006 |
| JP | 11-285740 | A | 10/1999 |
| WO | WO 2011/113621 | A1 | 9/2011 |
| WO | WO 2012/091346 | A1 | 7/2012 |

OTHER PUBLICATIONS

International Search Report (PCT/ISA/210) issued in PCT Application No. PCT/EP2015/061544 dated Sep. 16, 2015 with English translation (Six (6) pages).

German-language Written Opinion Report (PCT/ISA/237) issued in PCT Application No. PCT/EP2015/061544 dated Sep. 16, 2015 (Five (5) pages).

German-language Search Report issued in counterpart German Application No. 10 2014 211 658.9 dated Feb. 4, 2015 with partial English translation (Eleven (11) pages).

Chinese-language Office Action issued in counterpart Chinese Application No. 201580015319.4 dated May 15, 2017 with English translation (Fourteen (14) pages).

* cited by examiner

ROTARY SLIDE WITH COOLING AND TEMPERATURE-CONTROLLED ZONES

CROSS REFERENCE TO RELATED APPLICATIONS

This application is a continuation of PCT International Application No. PCT/EP2015/061544, filed May 26, 2015, which claims priority under 35 U.S.C. § 119 from German Patent Application No. 10 2014 211 658.9, filed Jun. 18, 2014, the entire disclosures of which are herein expressly incorporated by reference.

BACKGROUND AND SUMMARY OF THE INVENTION

The invention relates to a device for forming a sheet-metal part having a portion which as an undercut is separately moldable in the device, comprising a press-side ram and a swage and a die which is separately drivable, serves for molding the undercut, and interacts with an undercut contour which is disposed substantially in a filler slide which is rotatably mounted in the swage.

A device of this type is shown and described for example in EP 0 699 489 B1, wherein the rotary slide (rotary cam) shown is rotatably mounted by way of a cylindrical external contour in the swage and/or in a driver. This filler slide serves for configuring an undercut which, in EP 0 699 489 B1, is paraphrased using the term of a "negative angle" in relation to the upper face or external face, respectively, of the formed sheet-metal part. A plurality of dedicated filler slides are provided in order for an elongate and, in particular, arcuate undercut to be configured in/on a sheet-metal part. Each filler slide is disposed in a wedge driver tool (negative-angle forming die) which is disposed in the device described at the outset.

A combination of this type of a device and a wedge driving tool is shown in U.S. Pat. No. 6,523,386 B2, for example. An elastically supported forming ram for shaping the sheet-metal part in a global manner is disposed on the press ram, on the one hand, and a slide which is connected in fixedly driven manner to the press ram and which by way of an oblique guide acts in an actuating manner with the upward and downward movement of the press ram on the die which serves for molding the undercut and which is referred to as an operational slide, wherein the operational slide is infed to the filler slide by way of a swage-side guide of a driver.

Furthermore, U.S. Pat. No. 6,523,386 B2 has a filler slide which is rotatably mounted in the swage or driver, respectively, and which, by way of cylindrical bearing faces which are disposed in a dedicated manner on the circumference, interacts with respectively corresponding support faces which are configured in the filler-slide receptacle in the swage. Support faces which are configured directly in the filler-slide receptacle of the swage require a high-grade material for the swage so as to minimize the wear of bearing and supporting faces which, in particular, are of dissimilar hardness. Moreover, the production of circular-cylindrical support faces is complex and is possible only by using special machines/special tools. Furthermore, a blocking wedge for a locking hook is disposed on this known filler slide, the former by way of a planar support face bracing the blocking wedge in relation to a planar tension face which is disposed in the swage/driver and which serves for rotationally locking the filler slide. The swage-side tension face is disposed so as to be tangential to the circular contour of the bearing of the filler slide, having a tensioning region, lying outside this circular contour, for the blocking wedge.

While the disadvantage of complex production is indeed avoided by an assembly which is known from the abstract of Japanese patent no. 11285740 A and which has bearing faces which are configured in a dedicated manner on the filler slide and has support faces which are configured in a dedicated manner in the filler-slide receptacle in the swage, this is achieved at the cost of expensive manufacturing of the dedicated individual parts which finally also have to be tuned in a complex manner.

Moreover, it has proven successful in the past for structural components of vehicles, such as the A, B, and C-pillars, the roof bow, the side frames, the sills, the longitudinal beams, the transverse beams, etc., to be produced by means of hot forming. Literature also refers to hot-forming processes as form-hardening or press-hardening. The structural components of the body not only play a significant part in imparting stability to the vehicle, but also play a decisive role in terms of safety in the event of a crash. Hot-forming processes lend themselves for addressing the competing targets of reducing the component weight of structural components while maintaining the mechanical key performance indicators.

In order for form-hardened components to be produced, in particular in order for body components to be produced, two methods which are fundamentally dissimilar are known. In the case of direct hot-forming, a sheet-metal blank is heated in an oven to a temperature which lies above the austenitizing temperature of the steel, and is subsequently simultaneously formed and cooled, that is to say form-hardened, in a tool. In the case of indirect hot-forming, a completely shaped and trimmed component of steel is first made from a sheet-metal blank by cold-forming. This component is then heated in a heating plant to a temperature which is above the austenitizing temperature of the steel, and is subsequently form-hardened by rapid cooling in a tool. In both hot-forming methods, the sheet-metal blank or a ready-shaped and trimmed component of steel, subsequent to being heated to the austenitizing temperature, is thermo-mechanically formed in the tool, wherein thermo-mechanical forming is performed at a temperature which is above the austenitizing temperature Ac3 (approx. 830° C.), preferably at between 900 and 1100° C. Cooling down the formed workpieces is performed by means of cooling which is located in a closed tool body. On account thereof, components having particularly superior mechanical properties, in particular having high strength, may be produced. In order for undercut components to be produced, operational slides in combination with filler slides are required in these press-hardening tools (hot-forming tool).

A tool technology having cooled slides and filler slides is described in WO 2011/113621 A1.

German patent document DE 19723655 B4 shows a method for producing sheet-metal products by heating a measured sheet-metal, hot-forming the sheet-metal in a tool pair, hardening the formed product by rapid cooling down from an austenitizing temperature while said product is still held in the tool pair, and subsequent machining of the product.

The invention is based on the object of providing a device by way of which the disadvantages of the prior art may be overcome. It is a particular object of the invention to provide a device by way of which the manufacturing effort for producing hot-formed components may be reduced.

In order for this and other objects to be achieved, a device is provided according to the invention for a press for forming a sheet-metal part having a portion which, as an undercut, is separately moldable in the device. The device comprises a press-side ram and a swage and a die which is separately drivable, serves for molding the undercut, and interacts with an undercut contour which is disposed substantially in a filler slide which is rotatably mounted in the swage. The filler slide is transferable from a molding position to a position which exposes the undercut in the sheet-metal part, and vice-versa. Furthermore, at least one temperature-control installation by way of which the filler slide at least in portions is capable of being temperature controlled may be provided in the filler slide. By providing temperature-control installations, the filler slide which is configured as a rotary slide may be used in a hot-forming tool for producing hardened components.

Moreover, a plurality of temperature control installations by way of which individual portions of the filler slide are capable of being temperature controlled to dissimilar or identical temperatures may be provided. When these temperature-control installations are impinged with dissimilar temperatures, a further benefit is achieved in the region of the rotary slide in that what are referred to as soft zones (tailored tempering) may be generated in the component by way of the dissimilar temperature zones in the slide region. Soft zones are achieved in those regions in which comparatively warm temperature-control installations are provided, since the component is cooled down less rapidly in these zones.

The temperature-control installations in the longitudinal direction of the filler slide can be disposed sequentially. On account thereof, zones which, in the longitudinal direction of the undercut region of the component, are in sequence may be generated having dissimilar mechanical variables, in particular in terms of strength and/or ductility.

Additionally or alternatively, the temperature-control installations may be disposed beside one another. On account thereof, zones having dissimilar mechanical variables may also be achieved in a transverse manner to the longitudinal direction of the undercut region of the component. The degree of freedom in arranging the zones with dissimilar strength and/or ductility is thus enhanced.

The ducts may be disposed so as to be substantially mutually parallel. Advantages in the manufacturing of the filler slide result therefrom.

Furthermore, the ducts may be aligned so as to be substantially parallel with a rotation axis about which the filler slide is rotatable.

According to a first embodiment of the invention, the temperature-control installation may be configured as at least one duct through which a temperature-controlled medium flows, in particular a gas and/or a fluid. Temperature-control of the rotary slide by means of a gas or a fluid offers the advantage of continuous temperature-control, wherein the temperature in the respective portions of the rotary slide may be maintained in very constant manner.

In a second embodiment of the invention, the temperature-control installation may be configured as at least one depression in the shape-imparting surface of the filler slide. The shape-imparting surface of the filler slide is a face of the slide which comes into contact with the sheet metal to be shaped. By configuring a depression, an air gap between the sheet metal and the filler slide is enclosed when the sheet metal is being hot-formed. This air gap serves as a local thermal insulator, preventing rapid cooling of the local region, wherein soft regions in the sheet-metal part are implemented by this portion.

In a third embodiment, the temperature-control installation is configured as at least one electric heating cartridge. Electric heating elements offer advantages in that they are capable of being rapidly set to the desired temperature. Moreover, the temperature may be controlled and/or regulated in a very accurate manner.

However, the embodiments which have been described above may also be combined with one another such that a plurality of temperature-control installations of dissimilar design are capable of being combined in one rotatable filler slide.

Water, coolants, oil, emulsions and/or combinations thereof are suitable as a medium.

Furthermore, the filler slide which is rotatable between a molding position and a position which exposes the undercut in the sheet-metal part may be supported in relation to corresponding support faces in the filler-slide receptacle in the swage by way of bearing faces which are circumferentially disposed, wherein the filler slide is configured having bearing faces which have a flat planar design and which toward the end of a rotation movement of the filler slide from the exposing position to the molding position land on support faces which are of a likewise flat planar design in the filler-slide receptacle. The advantage of planar bearing faces and of planar support faces lies in the absence of friction-based contact between the corresponding faces in the event of rotation of the filler slide, on account of which wear on these faces is avoided.

Substantially non-contacting landing, without wear, of a bearing face on an associated support face in a design embodiment of the invention is achieved in that the bearing faces of the filler slide in the rotation direction toward the molding position are, in each case, delimited by a radial line which emanates from the rotation axis of the filler slide, each radial line with a respective bearing face forming at least a right angle (90°).

Non-contacting landing without complex tuning measures in a further advantageous manner is achieved in that the filler slide for the flawless planar interaction of the bearing faces thereof with the corresponding support faces on the swage side has a rotary guide which either has a predefined enlarged clearance in the bearing, or which according to further proposals is equipped with a radially resilient elastic intermediate element, preferably in the embodiment of a rubber bush or of a corrugated sheet-metal bush of spring steel. A rotary guide of the filler slide which is disposed so as to be eccentrically disposed in the direction of the swage-side support faces and which by the way is capable of being combined with the aforementioned assemblies is also contemplated.

Depending on the number and on the reciprocal angular positions of the bearing faces and support faces, it is provided with a view to the aforementioned assemblies for fixing the filler slide for configuring a flawless undercut that the filler slide in the molding position is locked in a rotationally fixed manner to the swage, specifically in the radial and/or axial direction.

In a refinement according to the invention, an axle which penetrates the filler slide across the length thereof and which, on the swage side, is fixedly disposed is possible as the above-mentioned rotary guide for the filler slide, on the one hand, or fulcrum pins disposed at both ends of the rotary slide for mounting in static bearings provided on the swage side are possible. Instead of the resilient rotary guides mentioned above, these static bearings by means of an elastic intermediate layer may be disposed so as to be movable in the direction of the support faces which are disposed in the filler-slide receptacle.

In a development of the filler slide, it is furthermore proposed that the filler slide is formed from a cast-iron alloy, cast steel or gray iron, from tool steel, or from a steel alloy having copper material, and that the bearing faces and the swage-side support faces are configured separately on hardened strips or strip portions from a case-hardened steel.

Instead of the landing technique of the bearing faces on the support faces, described above, by means of slightly displaceable filler slides, it is also possible for the support faces to be provided on pistons which are disposed in the swage so as to be hydraulically controlled and lockable and which impact on the bearing faces which are disposed in the molding position of the filler slide.

A further proposal relates to the die, which serves for molding the undercut, to be provided as an operational slide in a wedge-driver tool that has been described at the outset. The operational slide is movable in relation to the filler slide by way of a slide bed which is moved on the ram side and by way of a driver which is at least in portions disposed in/on the swage.

The actuation of dies by wedge-driver tools in the case of a plurality of filler slides which are disposed in particular in an arcuate manner in a press device for molding an arcuate undercut may instead be provided in that the dies are driven separately from the press-ram movement, for example by way of piston/cylinder units which are effective in a hydraulic or pneumatic manner.

Further advantages of the invention are to be mentioned in a summarizing manner hereunder. The present crash-related requirements which are set for the vehicle body in particular in the loading event of a side impact, for example in the case of the B-pillar reinforcement component, may be implemented by the above-described device by zones having dissimilar strength in a component. The so-called soft zones (tailored tempering) are presently produced by particular tooling techniques (air gap, heating cartridges) in the cooling process within the tool, or are implemented by external process steps outside the hot-forming tool (oven technology with dissimilar temperature zones, subsequent annealing of the component). The soft zones in regions having an undercut can only be produced within the tool by using the filler-slide technology method described above. A rotary slide having integrated zonal cooling has, inter alia, the following advantages:

- minor space requirement; smaller tools may be constructed on account thereof;
- comparatively less constructional effort than the combination of two slides (forming slide and filler slide), on account of which the economic efforts may be reduced;
- using regional cooling in a rotary slide, a component having soft zones also in the region of an undercut geometry is possible;
- rotary slides are not only suitable for hot-forming steel but also for materials such as aluminum and magnesium.

The invention is described by way of device for a press for forming a sheet-metal part having an undercut, which in the drawing is shown only in portions, and by way of a filler slide which is illustrated in the cross section.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
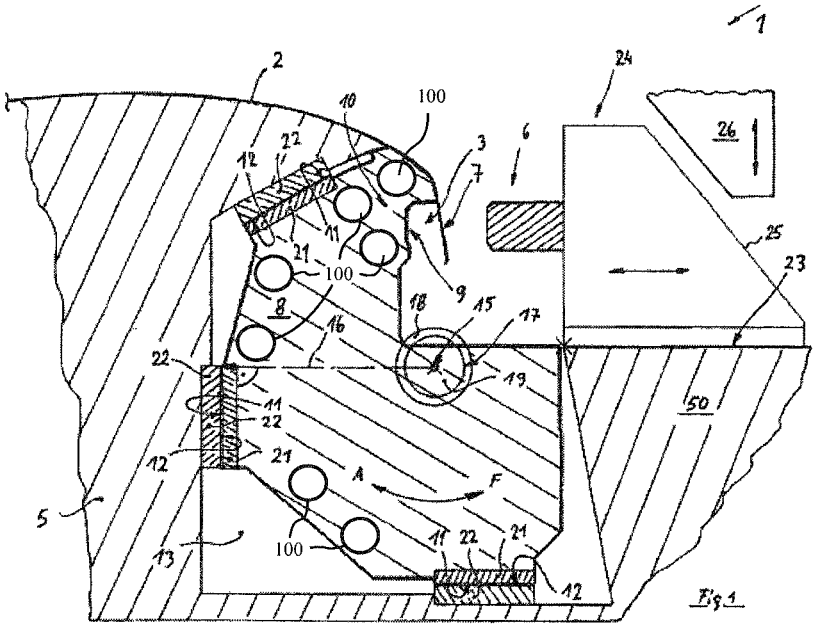
FIG. 1 shows a filler slide, illustrated in cross section, in the molding position for an undercut, in a device which is generally indicated.

In FIG. 1, the device 1 (which is merely indicated) may be designed, for example, so as to be similar to that in FIG. 1 of the drawing of the above-mentioned EP 0 699 489 B1, for a press (not shown) for shaping a sheet-metal part 2. The sheet-metal part 2 preferably serves as a body panel, having a portion 4 of the body panel 2 which, as an undercut 3, is separately moldable (shaped) in the device 1. Beside a press ram (not shown), the device 1 includes a press swage 5 and a separately drivable die 6 which serves for molding the undercut 3.

In order for the undercut 3 to be molded in a peripheral region 7 of the body panel 2 to be molded, a rotatably mounted filler slide 8 is disposed in the swage 5, in which filler slide 8 the contour 9 for the undercut 3 is configured so as to shape the body-panel periphery 7 by way of the die 6. As can be seen from FIG. 1, the filler slide 8 herein assumes the position 10 for shaping the undercut 3 on the body-panel periphery 7. As can be furthermore seen from FIG. 1, the rotatable filler slide 8 is equipped with the bearing faces 11 which are circumferentially disposed and designed in a flat planar manner. These bearing faces 11, by way of a rotation movement of the filler slide 8 according to the arrow A in the direction of the molding position 10, are brought to bear in a planar manner on support faces 12, likewise of a flat planar design, in a filler-slide receptacle 13 which is disposed in the swage 5. In order for the completely molded undercut 3 to be exposed, the filler slide 8, which is designed according to the invention, is rotated according to FIG. 2 in the direction of the arrow F to the exposing position 14.

Figure 2:
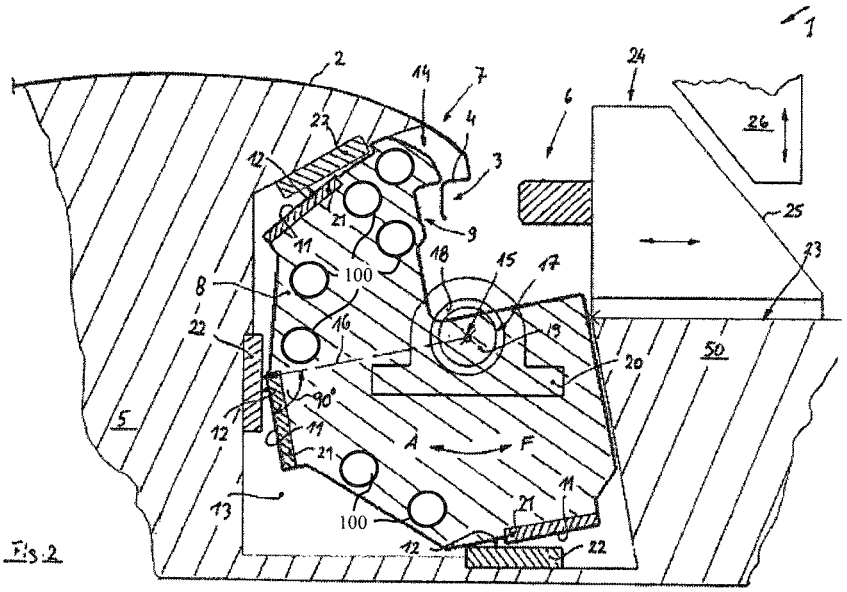
FIG. 2 shows the filler slide in a position exposing the molded undercut in a sheet-metal part.

Temperature-control installations 100, herein illustrated as ducts, which run parallel with the rotation axis 15 of the filler slide 8 and thus perpendicularly to the drawing plane of FIGS. 1 and 2 are provided in the filler slide 8. A medium, for example a gaseous or liquid fluid, may flow through the ducts. This fluid is set to a predetermined temperature. On account thereof, the rotary slide 8 may be temperature-controlled, that is to say cooled, in a targeted manner. By passing media which are set to dissimilar temperatures through the individual ducts 100, the individual regions of the rotary slide may be temperature-controlled in a dissimilar manner, that is to say cooled in a dissimilar manner. This temperature during hot-forming of the sheet metal 2 is transferred to corresponding regions in the sheet metal 2. Regions having dissimilar mechanical properties may thus be generated in the sheet metal 2, in particular in the undercut region 3 of the sheet metal 2.

In order for the bearing faces 11 to bear on the support faces 12 in a kinematically flawless manner, without contact causing grinding wear, the bearing faces 11 of the rotatable filler slide 8 in the rotation direction toward the molding position 10 are each delimited by one radial line 16 which emanates from the rotation axis 15 of the filler slide 8, wherein each radial line 16 in relation to a respective bearing face encloses at least one right angle—90°—, preferably of somewhat larger size such as approx. 92° to 95°. The arrangement of the support faces 12, except for the alignment in parallel with the filler-slide side bearing faces 11 on the filler slide 8 in the case of a closed position or in the molding position 10, respectively, is freely selectable.

In order for complex tuning work and cost-intensive tolerances in terms of production technology for the reciprocal alignment of the bearing faces 11 and of the support faces 12 to be reduced, the filler slide 8 has a rotary guide 17 with a bearing clearance which is enlarged to a predetermined size, on account of which flawless planar interaction between the bearing faces 11 and the corresponding support faces 12 is achieved in a simple manner.

The afore-described effect by way of another design embodiment of the rotary guide 17 is achieved in that the rotary guide 17, instead of an enlarged clearance, is equipped with a radially resilient elastic intermediate element 18. The latter may be a rubber bush having a Shore hardness of 60 to 80, preferably of 70, or be a corrugated sheet-metal bush of a spring steel. A further design embodiment results in that the rotary guide 17 of the filler slide 8 is eccentrically disposed in the direction of the swage-side support faces 12, this being preferably advantageous with one of the aforementioned intermediate elements 18.

Independently of the angular positions of the face pairs of bearing faces 11 and support faces 12, it is expedient for the filler slide 8 to be locked in a rotationally fixed manner in the molding position 10.

With reference to the configuration of the rotary guide 17, the filler slide 8 may be mounted on an axle which penetrates the filler slide 8 across the length thereof and is fixedly disposed on both ends on the swage side. In another configuration, the filler slide 8 is rotationally guided by way of fulcrum pins 19 disposed at both ends in static bearings 20 which are disposed on the swage side. These, by means of an elastic intermediate layer (not shown), may be movable in the direction toward the filler-slide receptacle 13, in a manner relative to the swage 5, in order for the bearing faces 11 to flawlessly bear on the support faces 12.

In the case of a filler slide 8 which is made from a cast-iron alloy, such as cast steel or gray iron, the bearing faces 11 and the support faces 12 are preferably configured separately on hardened strips 21, 22 from a case-hardened steel.

With reference to clearance-free interaction between the bearing faces 11 and the support faces 12 it is also contemplated for the support faces 12 to be provided on pistons (not shown) which are disposed on the swage 5 so as to be hydraulically controlled and lockable, wherein the filler slide 8 is disposed at minimum clearance and in a flexurally rigid embodiment in the swage 5.

In a device 1 having a plurality of filler slides 8 which are preferably disposed in an arcuate manner in one plane for configuring an arcuate undercut 3 in a sheet-metal part or a body panel 2, respectively, the dies 6 may be driven separately from the press ram (not shown) in order for the undercut 3 to be configured during the molding of the remaining body panel 2 which is caused by the press ram. Hydraulically or pneumatically effective piston/cylinder units (not shown) which are controlled by way of the movement of the press ram may be expedient for a linear drive of the dies 6 and of a rotation movement of the filler slides 8, which may optionally be combined with the former.

However, in a manner corresponding to the number of filler slides 8 which are disposed in an arcuate manner, the device 1 may also include a corresponding number of wedge-driving tools which are not shown but which are known per se from EP 0 699 489 B1 and U.S. Pat. No. 6,523,386 B2, mentioned at the outset, and which, as is known, are directly controlled by the movement of the press ram. As can be seen from FIGS. 1 and 2 of the present description of the drawings, the die 6 which is referred to as an operational slide 24, which is movable to and fro on the swage portion 50 which is designed as the drive 23, by way of the wedge face 25 thereof is moved in a controlled manner relative to the filler slide 8 by a slide bed 26 which is disposed on the ram side and which is only partially indicated.

Advantageously simple production of the device, in particular with a view to the filler-slide receptacle, without special machines and/or special tools is achieved by the invention.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A device for a press for forming a sheet-metal part with a portion which, as an undercut, is separately moldable in the device, comprising:

a press-side ram;

a swage;

a filler slide rotatably mounted in the swage about a rotation axis; and a die which is separately drivable, serves to mold the undercut, and interacts with an undercut contour, the undercut contour being disposed substantially in the filler slide, wherein the filler slide is transferable between a molding position and a position which exposes the undercut in the sheet-metal part, and a plurality of variable temperature control installations are arranged in the filler slide in a longitudinal direction of the filler slide, which is parallel to the rotation axis, each of the plurality of variable temperature control installations being variably temperature-controllable to a dissimilar temperature relative to one another, wherein the filler slide is temperature-controllable at least in portions via temperature control of at least one of the plurality of variable temperature control installations.

2. The device according to claim 1, wherein individual portions of the filler slide are temperature-controllable, via the plurality of variable temperature control installations, to dissimilar or identical temperatures.

3. The device according to claim 2, wherein the plurality of variable temperature control installations are arranged sequentially in the longitudinal direction of the filler slide.

4. The device according to claim 2, wherein the plurality of variable temperature control installations are disposed beside one another in the longitudinal direction of the filler slide.

5. The device according to claim 2, wherein the plurality of variable temperature control installations are aligned so as to be substantially mutually parallel.

6. The device according to claim 2, wherein the plurality of variable temperature control installations are aligned so as to be substantially parallel with a rotation axis about which the filler slide is rotatable.

7. The device according to claim 1, wherein the plurality of variable temperature control installations are configured as one or more of:

a duct through which a temperature control medium is flowable, a depression in a shape-imparting surface of the filler slide, and an electric heating cartridge.

8. The device according to claim 7, wherein the temperature controlled medium is a gas or a fluid that flows through the duct.

9. The device according to claim 7, wherein each of the plurality of variable temperature control installations is configured with at least one of the duct through which the temperature controlled medium is flowable, wherein the temperature controlled medium flowable through respective one of the ducts is controlled to dissimilar temperatures relative to one another.

* * * * *